United States Patent [19]

Kieber

[11] 4,285,372

[45] Aug. 25, 1981

[54] METHOD AND DEVICE FOR THE REFILLING OF DOUBLE CHAMBER PRESSPACK SPRAY CONTAINERS

[75] Inventor: Lothar Kieber, Mulheim an der Ruhr, Fed. Rep. of Germany

[73] Assignee: Deutsche Calypsolgesellschaft mbH & Co., Düsseldorf, Fed. Rep. of Germany

[21] Appl. No.: 78,735

[22] Filed: Sep. 25, 1979

[30] Foreign Application Priority Data

Sep. 25, 1978 [DE] Fed. Rep. of Germany ... 7828516[U]

[51] Int. Cl.[3] ..... B65B 3/04

[52] U.S. Cl. ..... 141/2; 141/20; 141/3

[58] Field of Search ..... 141/3, 44–51, 141/91, 92, 83, 2, 18–29

[56] References Cited

U.S. PATENT DOCUMENTS 3,561,503 2/1971 Rogge ..... 141/45

*Primary Examiner*—Houston S. Bell, Jr.

*Attorney, Agent, or Firm*—Martin A. Farber

[57] ABSTRACT

Device for the refilling of double-chamber pressure packet spray containers comprising an electromotor with a dosing pump which pumps the filling product from a storage container via a supply line to a filling tube, the tube corresponding with the spray valve of the container. A two-way solenoid valve is disposed in the feed line of the filling tube.

7 Claims, 1 Drawing Figure

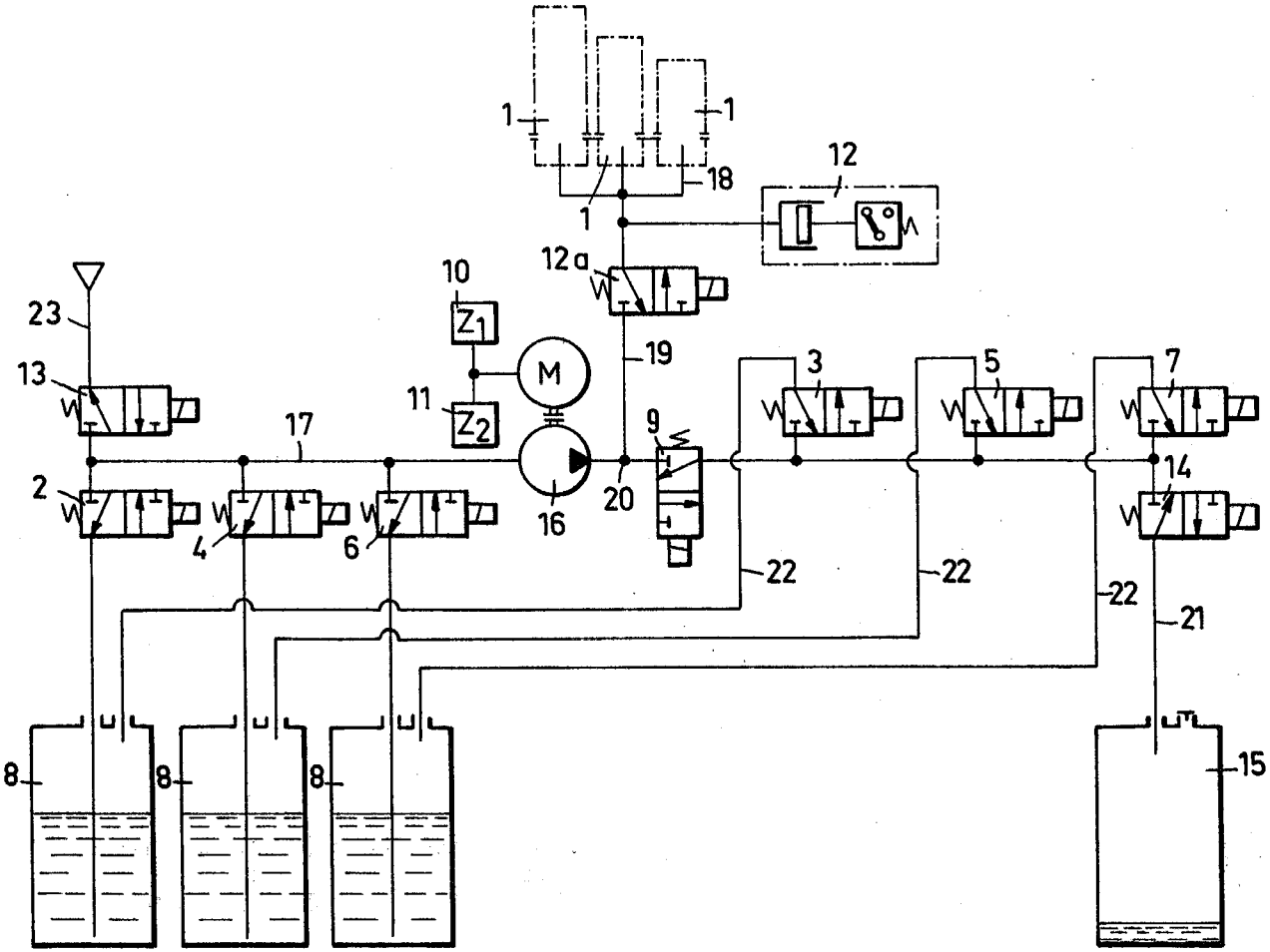
1
1
1
18
12
12a
19
20
9
3
5
7
14
21
22
22
22
15
M
16
10
Z1
Z2
11
6
4
2
17
13
23
8
8
8

METHOD AND DEVICE FOR THE REFILLING OF DOUBLE CHAMBER PRESSPACK SPRAY CONTAINERS

The invention relates to a method and device for the refilling of double chamber presspack spray cans or containers. Such spray containers are known. They have in their interiors an inner bag or pouch in which the product is to be found. The second space of the can, which space is not filled up by the inner bag, is preloaded with compressed air in such manner that by means of the spray device, the complete emptying of the first chamber is possible. Commonly, the spray containers of this type contain a pressure of 9 bar.

It is disadvantageous that up to now there is no device for the renewed filling of used spray cans of the presspack type, so that cans are discarded and destroyed even though the existing air pressure could be utilized again to spray out a product that has been reintroduced.

It is the task of the invention to create a device for the refilling of two-chamber presspack spray containers. This task according to the invention is solved by a method and device, which in a preferred form includes an electromotor with a dosing pump, which pump pumps the filling product from a storage container via a supply line to a filling tube, which tube corresponds with the spray valve of the container, a two-way acting solenoid valve (12*a*) being disposed in the feed line (19) of the filling tube (18). The customer can bring his empty spray container to a filling device of this type, pull the spray head off the container and bring the spray valve of the container in connection with the matching or corresponding filling tube of the device. By means of a switch or whatever other desired contact, the feed line is opened and by means of the pump the renewed filling through the spray valve of the spray container is performed.

It is advantageous to install a pressure switch (12) additionally in the feed line, which switch abruptly interrupts the supplying of the product when a pressure of 9 bar in the container is reached.

It is further advantageous to provide the motor with a timing relay or time limit relay, which relay causes its operation for a preset time and then causes its switching off. In order to make possible a cleansing operation of the system, if the device according to the invention is provided for the refilling of double-chamber presspack spray containers for several products, it is suggested in an advantageous embodiment of the invention to connect a return flow line to the feed line via a T-piece, the return flow line leading to a collector tank or reservoir, whereby product cleansing or purge lines with a built-in two-way electromagnetic or solenoid valve are connected to the return flow line.

Additional details, characteristics and advantages of the filling device of the invention are shown in the following description of the accompanying drawing which shows schematically a device for the refilling of two presspack spray containers.

The only FIGURE of the drawing shows three product containers or tanks 8 of similar construction, from inside which containers supply lines 17 with built-in two-way solenoid valves 2, 4, 6 lead to a dosing pump 16, which pump is actuated by a twelve-volt electromotor M. The dosing pump 16 is a per se known separation piston valve pump or cut-off slide pump, which pump is capable of conveying products of gel-type consistency that are in the container 8. The motor M is controlled by two timing relays $Z_1$ and $Z_2$ in the manner described below.

A feed line 19 with a built-in two-way solenoid valve 12*a* leads from the pump 16 to filling tubes 18 for spray containers 1, which containers 1 in mounted or upright position are shown in broken lines. The filling tubes 18 are matched or adjusted in their construction to the spray valve of the spray containers 1 and can be brought tightly into connection with the latter, for example by means of a screw-cap. In addition a pressure switch 12 is connected to the feed line 19, which switch 12 upon a pressure of 9 bar interrupts the supplying of the product by closing of feed line 19.

The filling of the containers 8 by means of a separate filling line 23 via an electromagnetic two/two-way valve 13 is shown schematically on one container in the drawing. The described system can be used for the refilling of spray containers without problem if only one product container 8 is present. By means of the twelve-volt electromotor M and the metering pump 16 the product is pumped into the spray container 1 via the valve of the spray container. In so doing, the product fills into the inner bag of the container 1, which bag then expands and builds up the same pressure again which was present with the original filling of the spray container. Upon the latter (the original filling), after filling of the product, compressed air was pumped in via a hole in the bottom of the container and the hole was subsequently closed mechanically by means of a rubber stopper. With a pressure of 9 bar the spray containers are completely filled. The refilling occurs dependent on the pressure switch 12, which switch is built or mounted into the feed line 19. If the pressure switch 12 signals a pressure of 9 bar, then the supplying of the product is interrupted.

In particular the method and operation proceeds as follows:

The customer brings his empty spray container to the filling device. There he pulls the spray head or atomizer off the container 1 and sticks or places the can overhead in the filling tube 18, which tube 18 runs to the container 1. Subsequently he locks the filling tube 18 by means of a screw-cap or screw closure, whereby the container 1 is pressed downward onto the filling nozzle. By doing this the line 17 is opened to the respective product container 8 by means of an electric contact, after which the filling can take place with motor and pump.

In order to enable the user to choose between several products, the device as shown in the drawing is equipped with three product containers 8. It is however also conceivable, for example, to integrate ten products. In order to avoid a mixing of products in the lines, a return flow line 21 with built-in two-way solenoid valves 9 and 14 is connected to the system by means of a T-member 20, the return flow line leading to a collector tank 15, in which collector tank 15 products which are flushed out of the pipes are collected. The containers 8, are connected to the return flow line 21 via lines 22 with built-in two-way solenoid valves 3, 5, 7.

With this device it is possible for the customer to choose three products with which he wishes to refill his spray container. For this purpose he pulls a switch which bears the label or inscription of the respective product. Thereupon the motor M, the pump 16, and the timing relay $Z_1$, which relay is provided with the reference number 10, go into operation. Simultaneously only those valves open which are in connection with the desired product on the intake or suction side as well as on the delivery or pressure side of the pump 16. The product is recycled or recirculated over the interval prescribed by the time limit relay 10, whereby the entire line system becomes air-free and clean. Upon expiration or running down of the time relay, the valve 9 on the pressure side is closed by means of a pulse, and instead the valve 12*a* to the filling station, i.e., to the filling tube 18, is opened. Now the product is fed into the spray container and indeed for such a duration until the pressure switch 12 registers a pressure of 9 bar. On the basis of this pulse a valve on the suction or intake side of the pump 16 is opened, which valve is open to the air, which leads to the instantaneous collapse of the vacuum pressure. In this manner a further sucking-in of the product does not occur.

Simultaneously the second timing relay $Z_2$ goes into operation, which relay is provided with the reference number 11. It closes the valve 12*a* to the container filling station and opens the valve 9 and 3, 5, or 7 on the pressure side of the pump, which latter valve leads to the corresponding product container 8. In this manner the product remnants which are still in the line are pumped back into the product container 8. In case of a time delay, a valve 14 to the collector tank 15 also opens, whereby a total emptying of the line system is guaranteed.

Upon the expiration of the time interval prescribed by the time limit relay, all the valves as well as motor and pump switch to "off" and the control light on the instrument console is extinguished. Now the container filling station can be reopened and the filled spray container can be removed.

I claim:

1. A method for refilling a double-chamber presspack spray container which has a spray valve, a product-holding inner bag communicating with the spray valve and a sealed, compressed gas chamber charged therein with compressed gas biasing the inner bag for dispensing the product through said spray valve without expelling said gas, and after the product has been dispensed with the inner bag being collapsed and the gas expanded and reduced in pressure, and without adding any additional compressed gas, comprising the step of inverting said container, connecting said spray valve to a supply of product to be refilled into said collapsed inner bag without adding any additional gas into the gas chamber, selectively metering the product into the collapsed inner bag so as to fill and expand said bag against the force of the gas and compressing and building up the pressure of the gas back to its original compressed gas pressurized condition without adding any additional gas into the gas chamber, disconnecting the supply of product from the spray valve, removing the refilled container with the refilled product and unused compressed gas.

2. A device for refilling a double-chamber presspack spray container which has a spray valve, a product-holding inner bag communicating with the spray valve and a sealed, compressed gas chamber charged therein with compressed gas biasing the inner bag for dispensing the product through said spray valve without expelling said gas, and after the product has been dispensed with the inner bag being collapsed and the gas expanded and reduced in pressure, and without adding any additional compressed gas, comprising means for releasably connecting the spray valve to a supply of product to be refilled into said inner bag, without adding any additional gas into the gas chamber, means for selectively metering the product into the collapsed bag so as to fill and expand said bag against the force of the gas for compressing and building up the pressure of the gas back to an original compressed gas pressurized condition without adding any additional gas into the gas chamber, means for disconnecting the supply of product from the spray valve, said connecting means further for removing the container with the refilled product and unused compressed gas.

3. The device as set forth in claim 2 wherein said metering means includes, an electromotor, a storage container containing the product and constituting the supply of product, a supply line operatively communicating with said storage container, a dosing pump being operatively connected to said electromotor, said pump including conduits and constituting means for pumping the filling product from said storage container via said supply line, a filling tube corresponding with the spray valve of the container and including said connecting means, a feed line being connected to said filling tube and operatively communicating with said supply line via said pump, said disconnecting means comprises a two-way solenoid valve being disposed in said feed line.

4. The device according to claim 3, further comprising a pressure switch is operatively installed in said feed line.

5. The device according to claim 3, wherein said motor has at least one time-limit relay, another two-way solenoid valve is built into said supply line.

6. The device according to claim 3, further comprising a T-piece, a collector tank, a return flow line leads from said T-piece to said collector tank, said feed line is connected to said return flow line via said T-piece, said supply is connected to said feed line via said T-piece, a product purge line is operatively connected to said return flow line, a two-way acting solenoid valve is built into said purge line.

7. The device according to claim 6, further comprising at least one additional two-way solenoid valves downstream of said T-piece of said dosing pump.

* * * * *